United States Patent [19]

Binaut

[11] 4,134,713

[45] Jan. 16, 1979

[54] COMPACT FLUID DRIVEN MOTOR AND REDUCTION GEAR MECHANISM

[75] Inventor: Jean D. E. Binaut, Auberchicourt, France

[73] Assignee: S.O.M.M.O.S., Auberchicourt, France

[21] Appl. No.: 706,293

[22] Filed: Jul. 19, 1976

[30] Foreign Application Priority Data

Jul. 21, 1975 [FR] France ..... 75 23074

[51] Int. Cl.[2] ..... F01C 1/20; F01C 13/00; F01C 21/04; F16H 1/20

[52] U.S. Cl. ..... 418/91; 418/99; 418/191; 418/199; 418/206; 74/414; 74/421 A

[58] Field of Search ..... 418/99, 191, 199, 205, 418/206, 91, 94; 74/412, 414, 421 R, 421 A

[56] References Cited

U.S. PATENT DOCUMENTS

| | | | |
|---|---|---|---|
| 437,259 | 9/1890 | Sprague | 74/421 A |
| 1,836,249 | 12/1931 | Holmes | 418/99 |
| 3,082,741 | 3/1963 | Huffman | 418/191 |
| 3,973,448 | 8/1976 | Michelsen | 74/421 R |

*Primary Examiner*—John J. Vrablik
*Attorney, Agent, or Firm*—Armstrong, Nikaido, Marmelstein & Kubovcik

[57] ABSTRACT

A reversible reduction gear motor which is driven by a pressurized fluid such as air or a liquid is provided having a hollow recoil rotor, which engages a drive motor and which is mounted rotatably on a shaft which extends through the recoil rotor. This shaft, which extends through the recoil rotor, has a reduction gear mounted on one end which engages a pinion mounted on one end of the shaft of the drive rotor. The other end of the shaft, which extends through the recoil motor, has a pinion mounted on it which engages a second reduction gear, the axis of rotation of which is coincident with the axis of rotation of the drive rotor. The driving fluid is supplied by conduits disposed within the motor and is controlled so that it can be supplied to drive the rotors in either a forward or reverse direction. In a particularly preferred embodiment of the present invention, the reversible reduction motors, which are particularly compact due to their unique construction, are mounted in groups of two or more to power the drum of a winch.

13 Claims, 6 Drawing Figures

COMPACT FLUID DRIVEN MOTOR AND REDUCTION GEAR MECHANISM

The invention relates to devices adapted to operate where a gaseous or liquid pressurized fluid source is available, and more particularly, because this invention is especially applicable to machines, is particularly adapted to devices used in civil engineering or mine workings and inter alia winches, pumps, drilling machines or moving devices. A main object of the invention is to so adapt such machines that they meet various practical requirements more satisfactorily than hitherto has been possible.

BACKGROUND OF THE INVENTION

Various industrial operations have required convenient sources of relatively high torque, low-speed power such as mining operations or other engineering projects. One of the requirements of devices for supplying such power is that they be sufficiently compact and small of size that they can fit in the often cramped space which the operation provides. Further, it is desirable that such devices have the size and geometry necessary so that a plurality of them can be employed together so as to multiply the amount of power available. Unfortunately, reduction devices heretofore employed have been relatively large and bulky due to the various gear arrangements necessary to translate high speed, low torque forces into slower speed, high torque rotation. Accordingly, such prior devices have not been readily adaptable to many uses, including incorporating them in combination as, for example, to drive the drum of a winch used to left heavy objects.

Accordingly, a main feature of the present invention, is to provide a compact device which comprises a geared engine comprising a drive rotor meshing with a recoil rotor rotating loosely on the shaft of a first step-down gearwheel controlled by a pinion mounted on the drive rotor. A second step-down train comprising a pinion is mounted on the shaft on the opposite side from that of the aforementioned gearwheel and has a gearwheel disposed on a second shaft which is an extension of the drive rotor shaft and has an output pinion by means of which the power supplied by the step-down unit thus described can be used for any apparatus requiring a step-down source of rotational power.

Apart from this main arrangement, the invention also comprises a special arrangement of the engine unit and its reversible distributor.

The invention also resides in a special arrangement of the bearing-supporting flanges enclosing the engine unit, the engine unit itself, and first and second step-down casings, the assembly being "stacked" using screws disposed parallel with the shafts of the rotors.

Lastly, the invention relates more particularly to a specific method of application to mining and civil engineering machinery, and also to certain embodiments of the aforementioned arrangements, the invention relating more particularly still, by way of novel industrial products, to machines of the kind specified comprising the application of a plurality of these devices in combination, the special elements required for their embodiment and assemblies or installations having machines of the kind specified.

In any case, the invention can be more clearly understood from the following description with reference to the accompanying drawings, the description and drawings being of course merely exemplary.

DETAILED DESCRIPTION OF THE DRAWINGS

Figure 3:
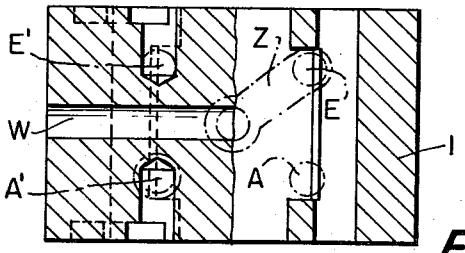
FIG. 3 is a half-section of the engine unit, sectioned along the line III—III.
Figure 2:
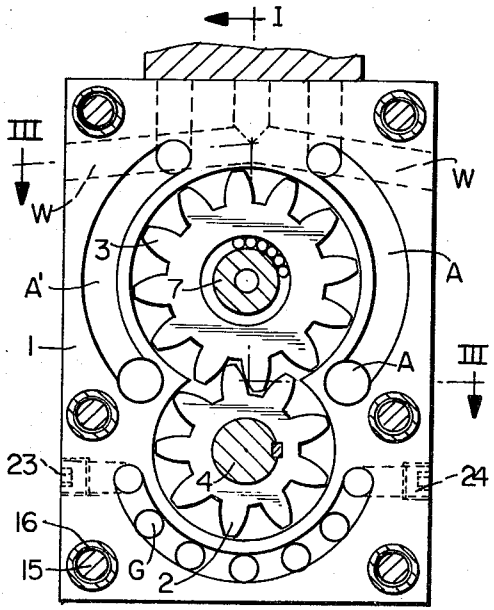
FIG. 2 is a sectional view taken along the line II—II.
Figure 1:
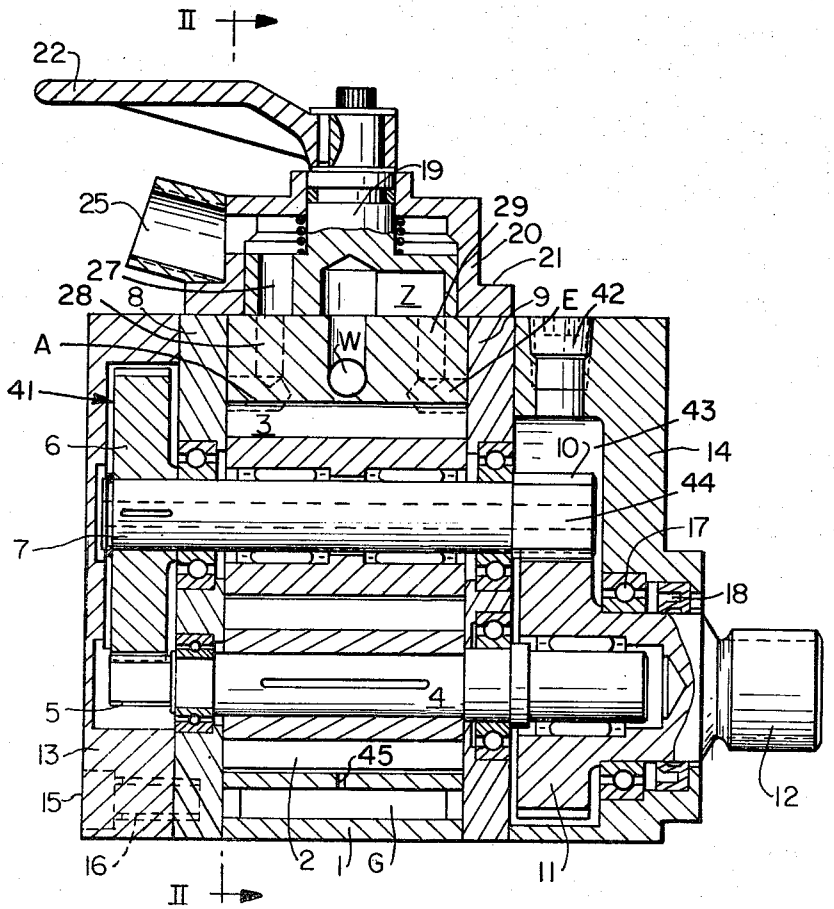
FIG. 1 is an elevation, sectioned along the line I—I, and partially along the line II—II, of the step-down system to which the invention mainly relates.

According to the present invention, and more particularly those applications thereof and those embodiments of its various parts which are preferred, with the object of providing a compact step-down unit which can be used on any machine, the device of the present invention is as follows:

The unit 1 formed with the necessary passages contains, a drive rotor 2 which engages a recoil rotor 3. The rotor 2 is mounted on a motor shaft 4 having a first step-down pinion 5 meshing with a gearwheel 6 which is mounted on a hollow shaft 7 extending through the recoil rotor 3 which rotates freely on the shaft. Flanges 8 and 9 enclose the unit 1 and support the bearings supporting the shafts 4 and 7.

At its outlet from flange 9, the shaft 7 having a bore 44 extends to the second step-down pinion 10 disposed in chamber 43 which drives the gearwheel 11 on the shaft whose axis of rotation coincides with that of the shaft 4 on whose end it rotates freely. This gearwheel 11, which engages the output of the drive shaft of the machine to be operated can, for instance, carry a pinion 12. The first step-down 5 and 6 is enclosed in gear chamber 41 in casing 13, the second stepdown 10 and 11 being received in the gear chamber 43 of casing 14. A plug 42 is provided also in end casing 14.

The unit 1, the flanges 8 and 9, the casings 13 and 14 form an assembly which is assembled by screws 15 disposed in centering sleeves 16 and whose projecting end, having a nut and washer, allows attachment to the frame of the machine to be driven. The casing 14 has a centering collar forming a bearing casing for the gearwheel 11 and a shaft output seal 18. In its upper part the casing has a plug 42 for the direct introduction of the lubricating oil into the gears of the second step-down 10 and 11 and via the hollow shaft 7 to the first step-down.

The upper face of the unit 1, forming a smooth surface, is provided with fluid inlet conduits A and A' and outlet conduits E and E' so disposed that the engine can be reversed by a slide valve 19 disposed in a casing 20 attached to the unit 1 by screws 21.

The driving fluid enters the device through the large conduit 25. An actuating lever 22 enables the slide valve 19 to be turned through the quarter of a revolution necessary to admit the fluid medium in one direction or the other through conduit 27 to 28, 28' or 29, 29' and to control the outlet suitably through E and E'. The medium can leave via a conduit Z in the slide valve 19 which connects the conduits E and E' to lines W emerging on the front and rear sides of the unit. Thus, the driving fluid which can, for example, be pressurized air or gas or a suitable liquid, is conveyed to the juncture of the two rotors 2 and 3, alternatively through either A or A' depending on whether the drive rotor 2 is to be driven in a clockwise or counter-clockwise direction respectively, and emerges through either the opposite conduit E' or E respectively.

The unit also has in its lower part an engine-lubricating oil reservoir disposed in cavities G which are interconnected by passage 45 and disposed concentrically of the rotor 2. A plug 23 or 24 borne by the unit 1 are provided to enable the oil reservoir to be filled.

The foregoing therefore defines a reversible geared engine with two rotors which operates reliably but has the following main features: The axis of the recoil rotor coincides with that of the step-down arrangement, the first step-down gearwheel and the second step-down pinion; the axis of the second step-down gearwheel and therefore of the output shaft is identical with that of the output rotor.

Clearly, any similar system combining these features to a greater or lesser degree is covered by the scope of the invention. Also clearly the invention covers various industrial apparatuses adapted to be actuated by a geared engine of the kind specified or a plurality of these engines. The device of the present invention has a particular advantage as regards the small amount of space which it occupies (due to the peculiar grouping of the drive and step-down elements), the convenience of demounting, and the facility of grouping a number of geared engines on the same apparatus to be driven, to increase its power as the user desires.

With particular regard to the latter feature, whereby a number of geared engines can be coupled on a single apparatus, an especially preferred embodiment consists in providing these engines either singly or two or more in combination on the side plate of a winch to drive the drum thereof. By this expedient, it is possible to double, treble or quadruple the power of the winch, and, if the other end of the drum is also fitted with the same gearing, to multiply this power to up to eight times that of the motor reduction module used. Further, since the said gearing can be internal or external, the user has available, simply by changing the drum, either of the "force/speed" ratios corresponding to this gearing, for each power selected, and where the motor reduction modules have two directions to rotation, they can be used for braking the winch under load.

Figure 4:
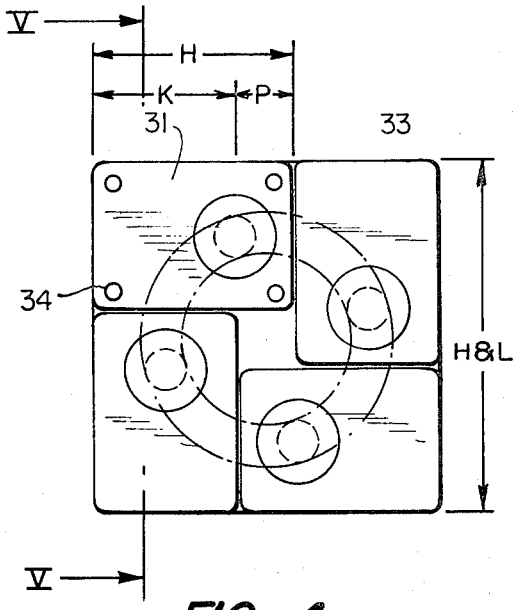
FIG. 4 is an elevation of the arrangement showing each motor unit of the winch, the principal subject of the invention.
Figure 5:
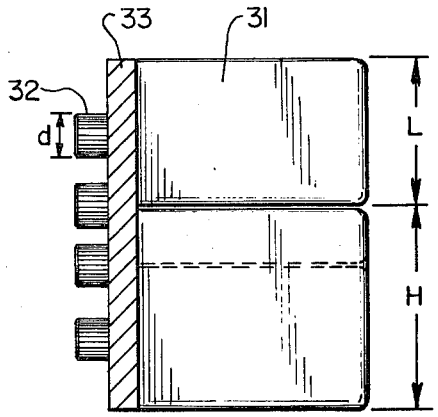
FIG. 5 shows the same arrangement in side elevation and section as indicated by a line V—V.
Figure 6:
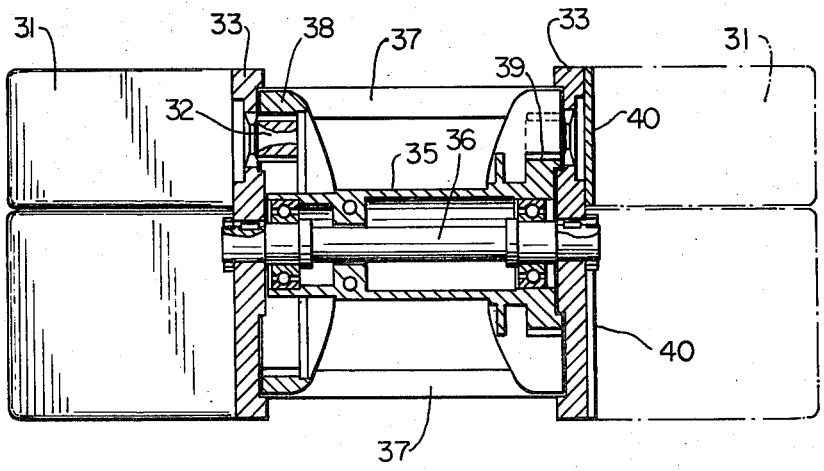
FIG. 6 represents a longitudinal section through a version of the assembled winch having two motor reduction units on each side plate.

Referring to FIGS. 4 and 5 a geared reduction unit 31 of the type previously shown and described herein is shown of substantially parallelepipedal shape, height H and width L, with an output pinion 32 of pitch diameter d, situated on the axis in the width direction and characterized by distances K and P along this axis, and a square bearing plate 33 whose side equals H+L and to which it is fixed by screws 34. It is significant that there is, in the right-hand or left-hand direction, one way, and only one, of arranging one, two, three or four similar motor reduction units so that they can drive a common rotating shaft.

The axis of the output pinions of these reduction units are situated at the intersections of the sides of a square whose side equals H and which is concentric with the plate and extensions of the sides of another square which is concentric with the first square and whose side equals H +L −2K, or, more simply, at the intersection between the square of side H and a circle of diameter cos a, in which a is such that tg a = (H +L −2K/H. This gives eight points of which four are for the "right-hand direction" and four for the "left-hand direction".

Consequently, the pitch diameter of an internally geared rim driven by the pinions of the motor reduction units is H/cos a + d, and that of an externally toothed wheel which can be driven by the same pinions is H/cos a − d.

In view of what has just been stated, it can be seen that the winch consists of a drum 35 rotating on a shaft 36 held between two sideplates 33 joined by spacers 37.

Inside either of both of its side numbers the drum 35 can receive either a toothed rim 38 or a wheel 39 integral with it.

It will be readily appreciated that as each of the sideplates 33 receives one, two, three or four motor reduction units 31, the power of the winch, i.e. the force applied at its hook, can vary from one to eight times that of the basic motor reduction module, and that it does so according to two "force/speed" ranges depending on whether the winch is equipped with rims 38 or wheels 39.

It is equally clear that one or some of the motor reduction units having two directions of rotation can be used as a brake, for example, when the load is held back, or in certain automatic devices to give the effect of substantially instantaneous stopping.

Lastly, it will be readiy recognized that when a position for a motor reduction unit remains empty on the sideplates 33 this position can easily be covered with plates 40 screwed onto the sideplates.

Hence, a winch is provided with two directions of rotation of which the longitudinal dimension remains the same up to four times the power of the basic motor reduction module and is increased only by the length of the module from four to eight times this power, and the transverse dimension is always the same irrespective of the power adopted.

For these reasons the winch obtained is of small dimensions and, therefore, light for a relatively large power output with all operating safeguards and with the following prinicpal features: a novel geometrical arrangement of motor reduction modules enabling its power to be varied; and a mechanical design capable of providing two "speed/force" ranges.

Clearly, any similar system which more or less combines these features comes within the scope of the invention.

Further, the invention covers all industrial apparatus which can be operated by such a combination of motor reduction units, which has numerous real advantages from the point of view of production, compactness, ease of dismantling and the possibility of increasing the power as the user desires.

What is claimed is:

1. A reversible reduction gear motor driven by a pressurized fluid comprising a hollow recoil rotor which engages a drive rotor, inlet and outlet means disposed within said motor to supply and remove respectively said pressurized driving fluid to said rotors, said recoil rotor being mounted on and rotating freely around a shaft extending through said recoil rotor, said shaft having a reduction gear mounted on one end thereof which engages a pinion mounted on one end of the shaft of said drive rotor, the other end of said shaft extending through the recoil rotor having a pinion mounted thereon which engages a second reduction gear, the axis of rotation of which is coincident with the axis of rotation of said drive rotor so that said drive rotor is positioned between said second reduction gear and the pinion mounted on the drive rotor shaft.

2. The motor of claim 1 wherein said second reduction gear is rotatably mounted on an extension of said drive rotor shaft and is provided with external means for engaging and driving an externally mounted device.

3. Apparatus as setforth in claim 1 characterized in that the two rotors are disposed in a common stator and are maintained in their longitudinal position by identical flanges in which bearings for the shaft are disposed.

4. Apparatus according to claim 3 characterized in that said flanges are formed in the walls of inlet and outlet conduits for the fluid which is fed by a distributor means carried by the stator wherein each of the inlet or outlet conduits are simultaneously supplied from two sides parallel to the axis of the rotors.

5. Apparatus according to claim 3 characterized in that the stator encloses a semicircular chamber on each face thereof which forms a storage reservoir for rotor-lubricating oil for both rotors.

6. Apparatus according to claim 3 characterized in that the reduction gears on both sides are positioned on the outside of said flanges.

7. Apparatus according to claim 6 characterized in that the reduction gears are enclosed in end-casings and are lubricated by continuous lubricating bounded by the end casing of the second reduction gear, the hollow shaft of the second reduction gear and the end-casing of the first reduction gear.

8. Apparatus according to claim 6 which is assembled in a parallelepipedic stacked fashion characterized in that by increasing the height of the motor housing and followingly increasing the length of said rotors the torque and force of the motor can be increased and vice-versa.

9. A winch having two directions of rotation, characterized in that a transversal section thereof receives one or more of the geared reduction motors of claim 1 within the limits of said section for the purpose of varying its power, wherein said motors each have identical transverse sections substantially without increasing their transverse or longitudinal dimensions.

10. A device as claimed in claim 9, characterized in that the minimum area for fixing the reduction motors to the sideplates of the winch is a square whose side equals the sum of the height H and width L of the reduction motors used.

11. A device as claimed in claim 10, characterized in that the axis of the output pinions of said motors are situated at the intersections of a square of side H and a circle of diameter H/cos a, in which a is such that tan a = (H +L −2K/H, K being the greater distance from the pinion axis in the direction of the height of the motor.

12. A device as claimed in claim 11, characterized in that the resulting arrangement permits the driving of a single rim or a single wheel mounted on the drum and therefore the obtaining of two different "speed/force" ranges, which by differentiation of supply of two groups of said motors permits stopping by braking under load; this rendering unnecessary the use of a bulky mechanical brake in the case of hoisting.

13. A device as claimed in claim 11, characterized in that the pitch diameters of this rim or wheel are H/cos a + d and H/cos a − d, d being the pitch diameter of the pinions of the motors.

* * * * *